US006010343A

United States Patent [19]

Konoya et al.

[11] Patent Number: 6,010,343

[45] Date of Patent: Jan. 4, 2000

[54] CONNECTOR

[75] Inventors: Hisashi Konoya; Hideto Nakamura, both of Yokkaichi, Japan

[73] Assignee: Sumitomo Wiring Systems, Ltd., Japan

[21] Appl. No.: 09/128,383

[22] Filed: Aug. 3, 1998

[30] Foreign Application Priority Data

Aug. 18, 1997 [JP] Japan ..... 9-221780

[51] Int. Cl.[7] ..... H01R 13/44

[52] U.S. Cl. ..... 439/144; 439/521

[58] Field of Search ..... 439/138, 142, 439/144

[56] References Cited

U.S. PATENT DOCUMENTS

| | | | |
|---|---|---|---|
| 4,784,610 | 11/1988 | Stuart | 439/144 |
| 5,584,710 | 12/1996 | Koshikawa et al. | 439/138 |
| 5,613,872 | 3/1997 | Fukuda et al. . | |
| 5,651,693 | 7/1997 | Fukuda et al. . | |

FOREIGN PATENT DOCUMENTS

| | | |
|---|---|---|
| 0 219 640 | of 1987 | European Pat. Off. . |
| 0 777 301 | of 1997 | European Pat. Off. . |
| 89 13 061 | of 1990 | Germany . |
| 44 46 299 | of 1995 | Germany . |

*Primary Examiner*—Michael L. Gellner
*Assistant Examiner*—Antoine Ngandjui
*Attorney, Agent, or Firm*—Anthony J. Casella; Gerald E. Hespos

[57] ABSTRACT

A connector is constructed to reduce a risk of malfunction or impairment of the connector due to the entrance of dust and/or external matter thereinto. The entrance of external matters into a receptacle 13 is prevented because an opening 16 of the receptacle 13 is normally kept closed by a cover 21 biased by a spring member 28. The cover 21 is temporarily opened against the biasing force of the spring member 28 during the insertion and withdrawal of the female connector housing 30.

9 Claims, 4 Drawing Sheets

CONNECTOR

BACKGROUND OF THE INVENTION

1. Field of the Invention

The present invention relates to a connector provided with a cover for substantially covering an opening of a receptacle for a mating connector housing.

2. Description of the Prior Art

A prior art male connector housing is provided with a receptacle for accommodating a female connector housing and has a plurality of male terminal fittings assembled inside with the leading ends projecting into the receptacle. The prior art female connector housing is configured and dimensioned to be fit into the receptacle and has a plurality of female terminal fittings corresponding to the male terminal fittings assembled inside. When the female connector housing is fitted into the receptacle of the male connector housing, the female and male terminal fittings are brought into contact with each other, thereby establishing an electrical connection.

EP-A-0 777 301 shows a prior art connector having a double-lock cover, which is pivotally mounted on the connector housing and is to be closed when a mating connector is fitted in a connector receptacle provided in the connector housing. However, the above referenced prior art double-lock cover is biased by a biasing means in a direction to open the connector receptacle thus allowing the entrance of dust and/or external matter into the connector receptacle.

In view of the above, an object of the present invention is to reduce a risk of malfunction or impairment of the connector by the entrance of dust and/or external matter when the cover is in its rest position.

SUMMARY OF THE INVENTION

A connector in accordance with the subject invention comprises a connector housing provided with a receptacle for accommodating at least partially a mating connector housing. A cover is displaceable between positions to substantially open and substantially close an opening of the receptacle for allowing the at least partial insertion of the mating connector housing into the receptacle, and a spring member is provided for biasing the cover in a closing direction.

Since the cover is normally held in the position to substantially close the opening of the receptacle by being biased by the spring member, the entrance of dust and/or external matters into the receptacle can be prevented.

According to a preferred embodiment of the invention, the connector further comprises an opening degree restricting means for restricting any further displacement of the cover in an opening direction after the cover is opened to a specified or predetermined or predeterminable opening degree.

Accordingly, an opening degree of the cover is restricted in the case that a cover for opening and closing an opening a receptacle for a mating connector housing is provided and is biased to close the opening. Thus malfunction or impairment of the biasing function of the spring is avoided, thereby improving the overall operability of the connector.

The mating connector housing may be at least partially inserted into and withdrawn from the receptacle by temporarily opening the cover against the biasing force of the spring member. At this time, any further displacement of the cover in the opening direction is prevented by the opening degree restricting means after the cover is opened to the specified degree. This preferably prevents the spring member from being excessively deformed due to an excessive opening of the cover. Further, if it is determined as an operation manual that the cover can be opened to a position where it is restricted by the opening degree restricting means, the interference of the mating connector housing and the cover during the insertion and withdrawal due to an insufficient opening of the cover can be prevented.

According to a further preferred embodiment of the invention, the opening degree restricting means comprises at least one wall extending along the spring member.

Since the opening degree restricting means comprises the at least one wall extending along the spring member, it can protect the spring member from the interference of external matter and can act to guide the spring member during the mounting of the spring member.

Further preferably, the opening degree restricting means comprises two walls extending substantially along a portion of the spring member and fixed to the connector housing and/or the cover.

Most preferably, the opening degree restricting means is provided on the connector housing and substantially interacts with a contact portion of the cover, when the cover reaches the predetermined or predeterminable opening degree.

According to a further preferred embodiment, the opening degree restricting means is provided such that when the cover reaches its predetermined or predeterminable opening degree, the spring member is deformed elastically to the extent that it is still within a permissible elasticity range where the spring member normally can be restored elastically.

Preferably, the spring member is provided integrally or unitarily on the connector housing and/or on the cover.

Further preferably, the spring member is fixed or positioned on the connector housing by means of a spring bearing projection, which preferably is shaped substantially semiconically.

Most preferably, the cover is hinged pivotally on the connector housing by a hinge means comprising a support shaft provided on either one of the connector housing and the cover and a bearing portion provided on the other of the connector housing and the cover. The spring member acts at a side of the connector housing and the cover substantially opposite of the side where the opening for the insertion of the mating connector is provided.

These and other objects, features and advantages of the present invention will become more apparent upon a reading of the following detailed description and accompanying drawings.

DETAILED DESCRIPTION OF THE PREFERRED EMBODIMENT

Figure 1:
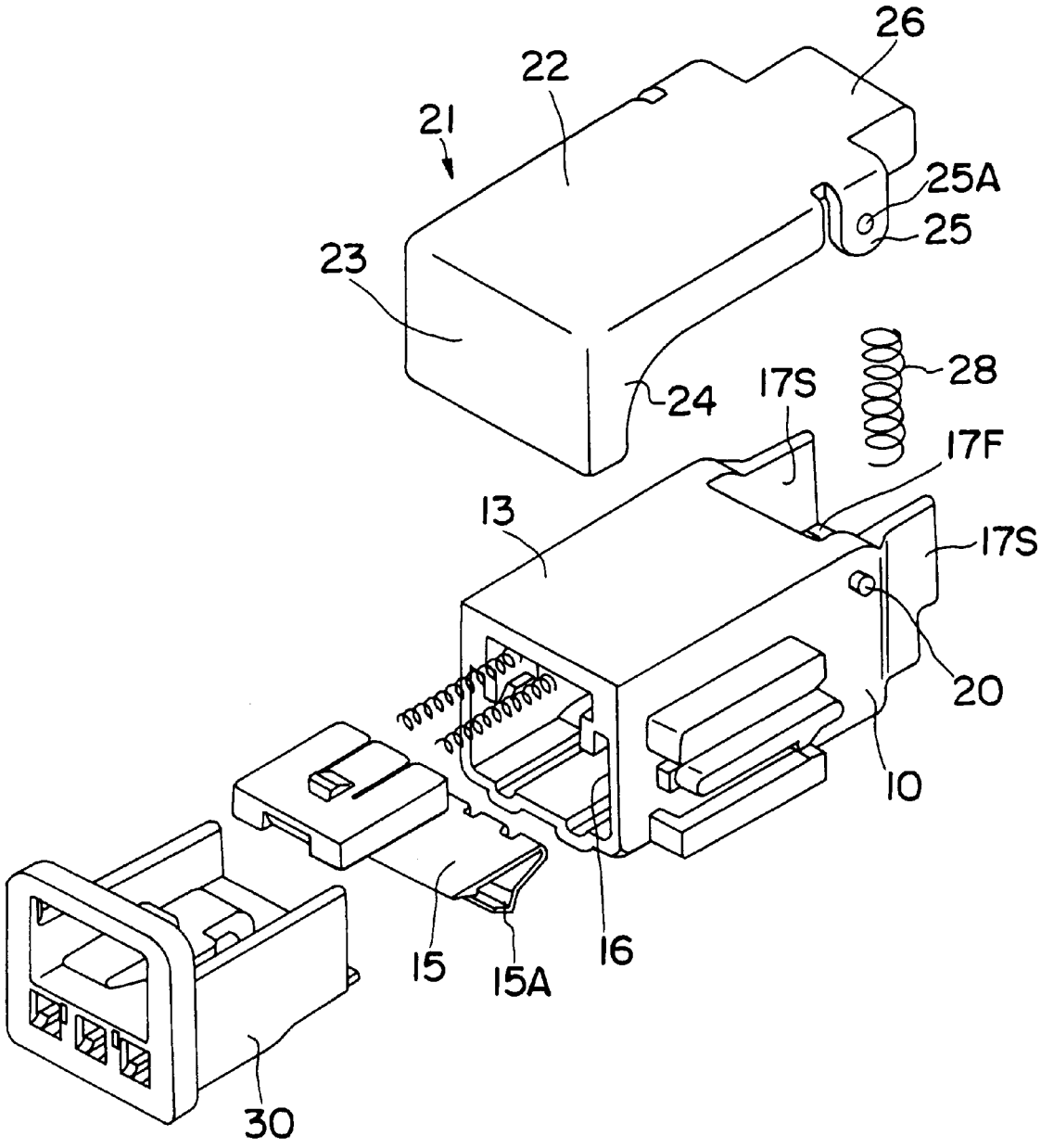
FIG. 1 is an exploded perspective view of a connector according to a first embodiment.
Figure 2:
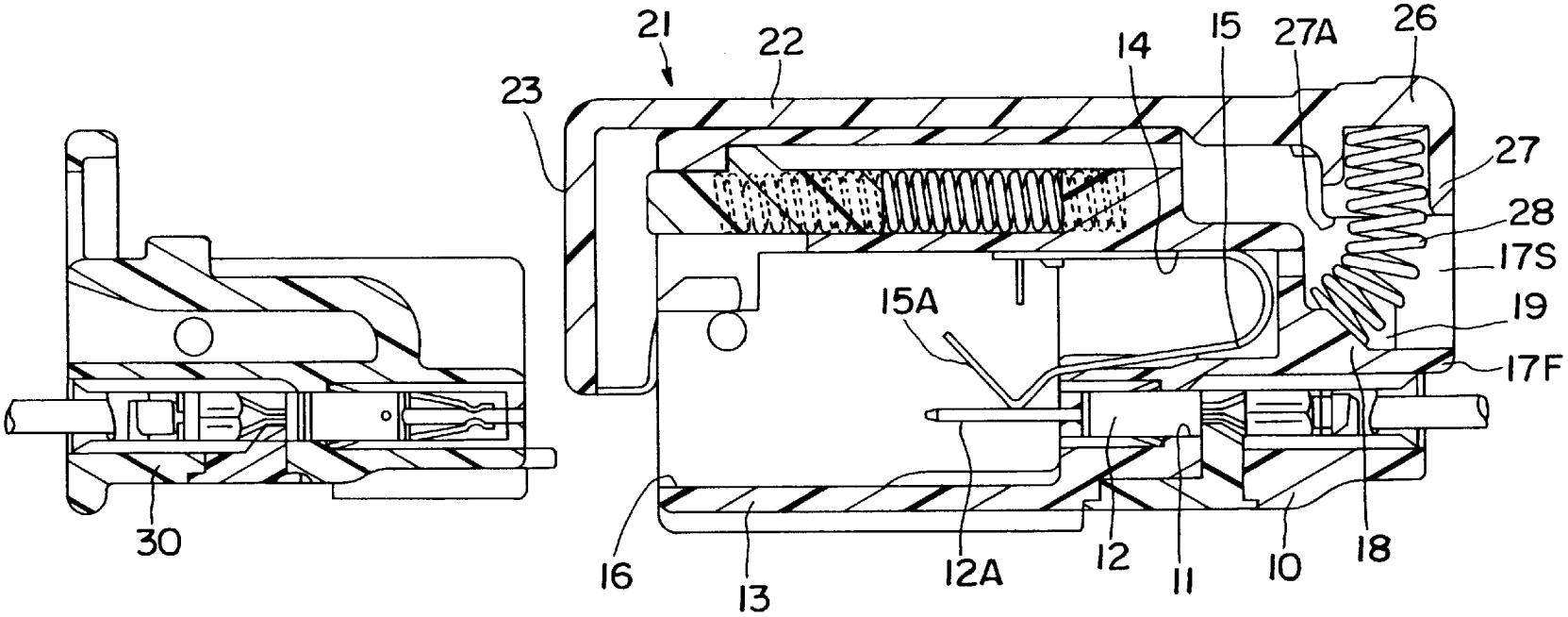
FIG. 2 is a section of connector housings in a detached state.

A male connector housing in accordance with the subject invention is identified by the numeral 10 in FIGS. 1–6. The male connector housing 10 has a plurality of male terminal fittings 12 accommodated in cavities 11 formed at a lower portion of the male connector housing 10. Tabs 12A at the leading ends of the male terminal fittings 12 project into a receptacle 13 which is formed in the male connector housing 10 to project substantially forwardly. Above the cavities 11 is formed a terminal accommodation space 14 substantially communicating with the receptacle 13. A short-circuiting terminal fitting 15, preferably having a substantially U-shaped cross section when viewed sideways (FIGS. 2 and 3), is accommodated in the space 14. A plurality of elastically deformable pieces or portions 15A at the leading end of the short-circuiting terminal fitting 15 are normally simultaneously in contact with the plurality of tabs 12A to short-circuit the male terminal fittings 12. An opening is formed at the front end of the receptacle 13 to define a receptacle opening 16, through which a female connector housing 30 (mating connector housing) is inserted into the receptacle 13.

The rear end surface of the male connector housing 10, or a surface substantially opposed to the receptacle opening 16, is characterized by a lower plate 17F which extends substantially backwardly from the bottom edge of the rear end surface. Side plates 17S extend substantially backwardly from the side edges or left and right edges of the rear end surface, and are substantially continuously formed with the rear end surface to define a substantially U-shaped frame. A substantially semiconically shaped spring bearing projection 18 is formed at a corner portion where the lower plate 17F and the rear end surface of the male connector housing are continuous at a right angle. The spring bearing projection 18 projects from a center position with respect to transverse direction obliquely upwardly and to the back.

A pair of restricting walls 19 (opening degree restricting means), that preferably have a substantially rectangular shape when viewed sideways, are formed on the opposite sides of the spring bearing projection 18. Specifically, this pair of restricting walls 19 are located at the left and right sides of the spring bearing projection 18 so as to conceal the spring bearing projection 18 when viewed sideways and to restrict the pivoting movement of a cover 21 in an opening direction OD, as described more in detail hereinafter.

A pair of support shafts 20 are formed in positions at the rear ends of the opposite side surfaces of the male connector housing 10, and a cover 21 is rotatably or pivotally supported on these support shaft 20. The cover 21 is comprised of: a ceiling plate 22, which can substantially face the upper surface of the male connector housing 10; a covering plate 23, which extend at an angle different from 0° or 180°, preferably substantially downwardly from the front edge of the ceiling plate 22 for substantially opening and substantially closing the receptacle opening 16; and side walls 24 which extend downwardly from the opposite side edges of the ceiling plate 22. A pair of bearing portions 25 are provided at positions corresponding to the support shafts 20 and preferably extend downwardly from positions of the opposite side edges of the ceiling plate 22 in proximity to the rear edge of the ceiling plate 22, and bearing holes 25A formed in the bearing portions 25 are fittable around the support shafts 20. In other words, the cover 21 is pivotal about the support shafts 20 between a closing position (see FIG. 2) where the covering plate 23 substantially closes the receptacle opening 16 and an opening position where the covering plate 23 is retracted, preferably substantially upwardly to substantially open the receptacle opening 16.

An area of the rear end portion of the ceiling plate 22 behind the support shafts 20 acts as a finger contact portion or actuation portion 26. By pushing this finger contact portion 26 by finger or any other actuator, the cover 21 can be displaced from its closing position to its opening position.

The finger contact portion 26 is formed with a spring bearing tubular portion 27 which projects downwardly to face the spring bearing projection 18. Between the tubular portion 27 and the projection 18 a spring member 28 is mounted or fitted. The spring member 28 preferably is made of a compression coil spring. Specifically, a loose movement of the upper end of the spring member 28 to the front, back, left and right is substantially restricted by being fitted or inserted into the tubular portion 27, and a loose movement of the lower end thereof to the front, back, left and right is restricted by being fitted on the projection 18. The cover 21 is biased toward its closing position by the spring member 28.

Figure 3:
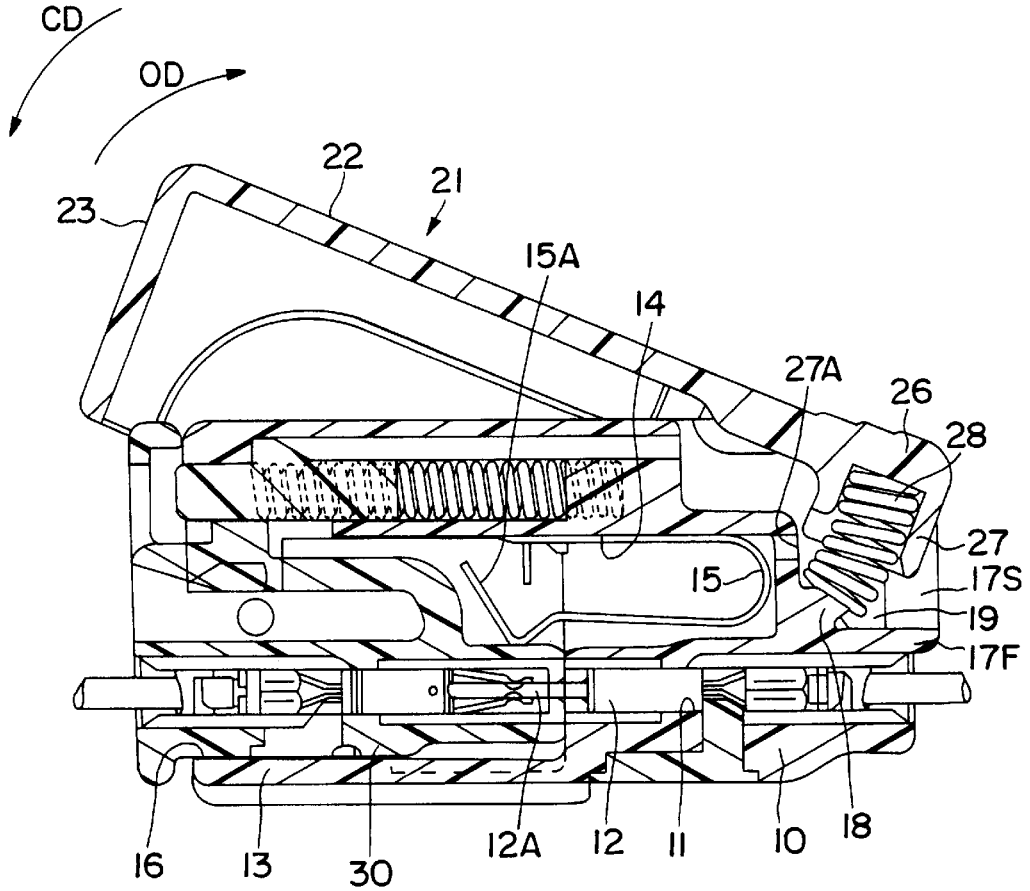
FIG. 3 is a section of the connector housings at an intermediate stage of the connection.
Figure 4:
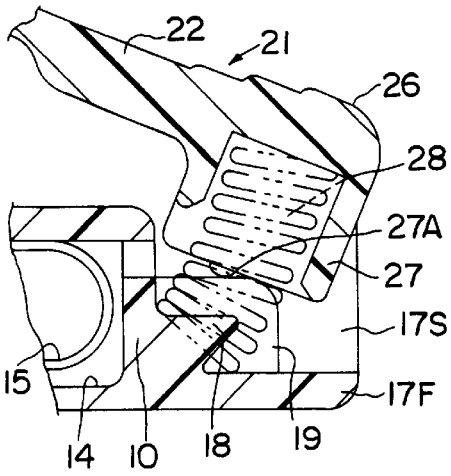
FIG. 4 is an enlarged partial section showing a state where the opening degree of a cover is restricted.
Figure 5:
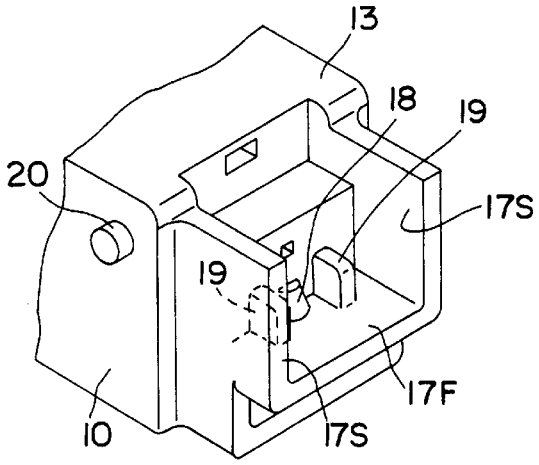
FIG. 5 is an enlarged partial perspective view of the male connector housing with the cover and a spring member detached therefrom.
Figure 6:
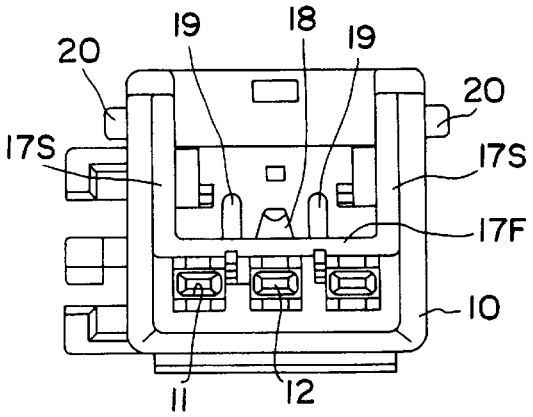
FIG. 6 is a rear view of the male connector housing with the cover and a spring member detached therefrom.

The bottom end of the spring bearing tubular portion 27 serves as a contact portion 27A which can be brought into contact with the restricting walls 19 obliquely from above. The contact of the contact portion 27A with the restricting walls 19 prevents the cover 21 from being displaced or pivoted further in the opening direction OD (FIG. 3). In a state where the opening degree of the cover 21 is restricted by the restricting walls 19, the bottom edge of the covering plate 23 is located slightly above the upper edge of the receptacle opening 16 so that the female connector housing 30 can be inserted into the receptacle 13. With the restricting walls 19 and the contact portion 27A substantially in contact with each other, the spring member 28 is deformed elastically to a maximum degree, which is still within a permissible elasticity range where the spring member 28 can be normally elastically restored.

The cover 21 is normally held in its closing position where the covering plate 23 substantially closes the receptacle opening 16 by being biased by the spring member 28 in a closing direction CD. Accordingly, dust and external matter are unlikely to enter the receptacle before the female connector housing 30 is fitted thereinto.

When the female connector housing 30 is to be inserted into the receptacle 13, the cover 21 is displaced from the closing position to the opening position against the biasing force of the spring member 28 by actuating, preferably pushing the finger contact portion 26 substantially from above. At this time, the finger contact portion 26 is strongly pressed until the contact portion 27A comes into contact with the restricting walls 19. Then, since the receptacle opening 16 is opened over its entire area, the female connector housing 30 is at least partially inserted or insertable into the receptacle 13 through the receptacle opening 16. The finger is disengaged from the finger contact portion 26 when the female connector housing 30 is completely accommodated. Consequently, the cover 21 is returned to the closing position (FIG. 2) by the biasing force of the spring member 28.

As described above, in this embodiment, when the cover 21 is displaced to the specified opening position, any further displacement thereof in the opening direction is prevented by the restricting walls 19. In this state, the degree of deformation of the spring member 28 is below the elasticity limit. Accordingly, the deformation of the spring member 28 beyond the elasticity limit resulting from an excessive opening of the cover 21 can be prevented securely.

If it is determined as an operation manual that the cover 21 be opened to a position where the contact portion 27A comes into contact with the restricting walls 19, the interference of the female connector housing 30 and the cover 21 during the insertion and withdrawal due to an insufficient opening of the cover 21 can be prevented.

Further, since the restricting walls 19 extend substantially along the spring member 28, the spring member 28 can be protected from the interference from external matter. The restricting walls 19 also act to guide the spring member 28 when the spring member 28 is mounted on the spring bearing projection 18.

The present invention is not limited to the described and illustrated embodiment, but the following embodiments also are embraced by the technical scope of the present invention as defined in the claims. Besides the following embodiments, a variety of other changes can be made without departing from the scope and spirit of the invention as defined in the claims.

Although the restricting walls (opening degree restricting means) are formed on the male connector housing in the foregoing embodiment, it may be formed on the cover 21 according to the invention.

Although the opening degree restricting means is embodied by the walls projecting along the spring member 28 in the foregoing embodiment, it may be formed in a position distanced from the spring member and may not be limited to the walls, but take an other form such as a tubular shape according to the invention.

Although a compression coil spring is used as the spring member 28 in the foregoing embodiment, a torsion coil spring or a leaf spring may also be used as the spring member 28.

Although the spring member 28 is a part separate from the male connector housing 10 and the cover 21 in the foregoing embodiment, it may be integrally or unitarily formed with the connector housing or the cover.

What is claimed is:

1. A connector, comprising:

a connector housing provided with opposed front and rear ends, support shafts extending transversely from the connector housing at locations between the front and rear ends, a receptacle with an opening at the front end of the connector housing for accommodating, at least partially, a mating connector housing, a lower plate extending from the receptacle to the rear end of the connector housing;

a cover having a ceiling plate with opposed front and rear ends, a pair of bearings between the front and rear ends of the ceiling plate pivotally mounted to the support shafts of the connector housing such that said cover is pivotably displaceable between first and second positions, a covering plate extending from said front end of said ceiling plate and dimensioned to substantially open the receptacle when the cover is in the first position for allowing the at least partial insertion of the mating connector housing into the receptacle, and to at least partially close the receptacle when the cover is in the second position, a finger contact portion extending forwardly from the rear end of the ceiling plate to the bearings thereof and disposed in spaced relation to the lower plate of the connector housing; and a spring member disposed between the lower plate of the connector housing and the finger contact portion of the cover for biasing the cover in a closing direction and into the second position to at least partially close the opening of the receptacle, whereby forces exerted on the finger contact portion enable opening of the receptacle for the at least partial insertion of the mating connector housing.

2. A connector according to claim 1, wherein the spring member is integrally provided on at least one of the connector housing and the cover.

3. A connector according to claim 1, wherein the connector housing includes a spring bearing projection which is of tapered shape, the spring member being fixed on the spring bearing projection.

4. A connector according to claim 1, further comprising an opening degree restricting means for restricting any further displacement of the cover in an opening direction after the cover is opened to a predetermined opening degree.

5. A connector according to claim 4, wherein the opening degree restricting means is provided on the connector housing and substantially interacts with a contact portion of the cover when the cover reaches the predetermined opening degree.

6. A connector according to claim 4, wherein the opening degree restricting means is provided such that when the cover reaches the predetermined opening degree, the spring member is elastically deformed to an extent that it is still within a permissible elasticity range where the spring member normally can be restored elastically.

7. A connector according to claim 4, wherein the opening degree restricting means comprises at least one wall extending along the spring member.

8. A connector according to claim 7, wherein the opening degree restricting means comprises two walls extending along opposite sides of the spring member and fixed to a selected one of the connector housing and the cover.

9. A connector, comprising:

a connector housing provided with a receptacle having an opening for accommodating, at least partially, a mating connector housing;

a cover which is displaceable between positions to substantially open and substantially close the opening of the receptacle for allowing the at least partial insertion of the mating connector housing into the receptacle;

a spring member for biasing the cover in a closing direction; and an opening degree restricting means for restricting any further displacement of the cover in an opening direction after the cover is opened to a predetermined opening degree, the opening degree restricting means comprising two walls extending along opposite sides of the spring member and fixed to a selected one of the connector housing and the cover.

* * * * *